US006896102B1

(12) United States Patent
Nichol

(10) Patent No.: US 6,896,102 B1
(45) Date of Patent: May 24, 2005

(54) ANGLED GRIPPING JOINT COMBINATION FOR SUPPORT STRUCTURES

(76) Inventor: James W. Nichol, 97 8th Ave NW, Nakusp, BC (CA), V0G 1R0

( * ) Notice: Subject to any disclaimer, the term of this patent is extended or adjusted under 35 U.S.C. 154(b) by 0 days.

(21) Appl. No.: 09/106,841

(22) Filed: Jun. 30, 1998

(51) Int. Cl.[7] ..... E04G 1/00
(52) U.S. Cl. ..... 182/186.5; 182/186.3
(58) Field of Search ..... 182/151, 185.1, 182/186.3, 186.4, 186.5, 186.7, 186.8, 224, 181.1, 153, 225, 227, 182.3, 182.2

(56) References Cited

U.S. PATENT DOCUMENTS 604,979 A * 5/1898 Garrett ..... 182/185.1
1,222,020 A * 4/1917 Myers ..... 256/64
1,597,555 A * 8/1926 Tolmie ..... 182/224
1,601,946 A * 10/1926 Dujardin ..... 182/224
1,780,579 A * 11/1930 Crowley ..... 182/224
1,797,543 A * 3/1931 Bryan ..... 182/224
2,132,285 A * 10/1938 Brown ..... 182/186.2
2,244,963 A * 6/1941 Poll ..... 182/224
2,736,614 A * 2/1956 Brewster, Jr. ..... 182/185.1
4,192,406 A * 3/1980 Mitchell ..... 182/185.1
4,238,001 A * 12/1980 Alexander ..... 182/153
4,911,390 A * 3/1990 Flick ..... 248/168
5,141,077 A * 8/1992 Zuercher ..... 182/185.1
5,269,394 A * 12/1993 Haroldson, Sr. ..... 182/113
5,364,312 A * 11/1994 Cunard et al. ..... 182/186.3 X
5,377,780 A * 1/1995 Dunaway ..... 182/185.1
5,484,037 A * 1/1996 Neumarkel ..... 182/224 X

* cited by examiner

*Primary Examiner*—Alvin Chin-Shue
(74) *Attorney, Agent, or Firm*—Bull, Housser & Tupper

(57) ABSTRACT

An apparatus used in the assembly and structure of tables, benches, sawhorses, and scaffolds. In particular, the invention discloses a U-beam top joint with lumber end gripper used with a U-beam splay bar, which are used in pairs or greater multiples to hold pieces of lumber in the required position to form a structure. The combination can be readily transported to a recreation or construction site and used to assemble a picnic table, bench, sawhorse with lumber fence, bench, scaffold or like structure with available lumber, cut to form the desired height for the structure. The U-beam top joint with lumber end gripper and the U-beam splay bar interact with the lumber legs and cross-beam such that an increase in load on the cross-beam causes a proportional increase in the rigidity and stability of the structure. The U-beam top joint and the U-beam splay bar each have side lumber brackets by which multiple top joints and splay bars can be linked to each other.

11 Claims, 9 Drawing Sheets

ANGLED GRIPPING JOINT COMBINATION FOR SUPPORT STRUCTURES

FIELD OF THE INVENTION

This invention relates to apparatus used in the assembly and structure of tables, benches, sawhorses, sawhorses with lumber fences, scaffolds, platforms, picnic tables and like structures. It is convenient to be able to assemble such a structure at the site at which the structure is to be used. The structures would often be too heavy or unwieldy to transport readily to the site, particularly picnic tables or large sections of scaffolding. In the case of sawhorses, it is moreover an advantage to assemble a sawhorse or chopsaw table that is customized to the sawyer's height and task, in order that he can do his sawing at a comfortable level, typically somewhere between the sawer's knee and chest, according to his preference and the size and shape of the lumber to be sawn.

DESCRIPTION OF THE PRIOR TECHNOLOGY

Kindly acknowledge delivery of the enclosed documents by appropriately endorsing and returning to me the enclosed copy of this letter. There exist a variety of simple joints and brackets used to join pieces of wood together to make a table, sawhorse or other legged structure out of timber. Generally such devices are shaped simply to fit the required pieces of wood placed into a platform support orientation, and are then nailed or screwed to the respective pieces of wood to join them and thereby attempt to retain them in that orientation. The difficulty with such devices is that the configuration is weakened by a load being placed upon the sawhorse structure. The legs tend to splay to the point of collapse under a load, the nails or screws can be worked loose by such pressure, and the whole structure can easily become wobbly and unstable.

SUMMARY AND OBJECTS OF THE PRESENT INVENTION

The present invention provides a combination that joins pieces of lumber to form a table, bench, sawhorse, scaffold, or like structure in such a way that assembly is very easy, and yet the resulting structure is rigid, stable, and increasingly rigid and stable upon a load being placed on the structure. The combination can be readily transported to a construction site or recreation site and used there to assemble a picnic table, a bench, a sawhorse, a scaffold or a similar structure, with available lumber, cut to form the desired height for the structure.

In particular, the invention discloses a U-beam top joint with lumber end gripper and a U-beam splay bar, which are used in pairs or greater multiples to hold pieces of lumber in the required position to form a support structure such as a table, bench, sawhorse, or scaffold. The U-beam top joint with lumber end gripper comprises at least one strong support U-beam affixed to strong inward facing end brackets, the U-beam adapted to support a cross-beam lumber top for the structure and the inward facing end brackets having a pair of angled inside ends to fit a top portion of a pair of angled lumber legs flanking the cross-beam lumber top. The U-beam splay bar comprises a strong U-beam re-formed at each end into two angled outward facing end brackets to fit a middle portion of the pair of angled lumber legs. The U-beam top joint with lumber end gripper and the U-beam splay bar interact with the lumber legs and cross-beam such that an increase in load on the cross-beam causes a proportional increase in the rigidity and stability of the structure. This is accomplished by having the inner sides of the top portion of the lumber legs press against the sides of the cross-beam lumber top, which also rests on the top surface of the top joint. When the U-beam top joint with lumber end gripper is in position, it retains the the top portion of each of the lumber legs in a position against the sides of the cross-beam lumber top, while the U-beam splay bar forces the middle portion of the legs apart. The U-beam top joint with lumber end gripper thereby acts as a pivot on each lumber leg to press the inner side of the top portion of each of the lumber legs against the respective sides of the cross-beam lumber top.

A preferred embodiment of the invention is to have the U-beam top joint and the U-beam splay bar made out of molded aluminum, or out of extruded and welded ⅛" thick aluminum, which can be transported to the required site in a small package. Once there, onsite lumber could be used with the invention to make the desired structure. Alternatively, the lumber required for the table or like or like structure could be previously cut and transported in an assembled, compact pile, without taking the extra space during transportation that an assembled table, bench, sawhorse, or like structure would take up. Once the leg and top timbers are cut to an appropriate length for a sawhorse, for example, the assembly time is approximately thirty seconds. Likewise the support frame for a picnic table can be assembled in approximately thirty seconds, leaving only the table top to be secured.

The assembly is accomplished with the pieces upsidedown from their orientation in the final working structure. The cross-beam lumber top is placed upsidedown on the ground. A pair of top joints are place upsidedown on the cross-beam lumber top, adjacent to either end thereof, with the two angled end brackets of each of two U-beam top joints protruding respectively on each side of the cross-beam lumber top. A lumber leg top is inserted into each of the two spaces formed between the cross-beam lumber top and the two angled end brackets of one of the rectangular top joints. The U-beam splay bar is then placed between the two lumber legs, with its outward facing end brackets respectively fitting a middle portion of the lumber legs. The assembler then presses down on the U-beam splay bar to force the middle portion of the lumber legs as far apart as the top ends (still upsidedown on the ground) of the lumber legs that are pivotted against the cross-beam lumber top (also still on the bottom) will allow. One or more nails or screws should be inserted through each of the brackets of the U-beam splay bar and into each the lumber legs. Another pair of lumber legs and U-beam splay bar are likewise assembled on the remaining end of the cross-beam lumber top in the other top joint. The support structure can thereby be made into a rigid unit from the various pieces of lumber and the interaction of the top joints and the splay bars. The entire assembled structure can then be inverted into its working, upright orientation.

A pair of such benches made with this angled gripping joint combination can be themselves joined to make a larger structure. If a pair of benches are joined by a transverse length of lumber through the side brackets of each of two aligned pairs of top joints, the resulting structure can form the base for a work platform or a camper top stand, or to form a four-sided safety barrier around a hazard, or can be used as the base for another couple of such structures, integrated with several more lumber lengths to make a picnic table.

Such transverse lumber lengths can also be used as a support fence for large pieces of lumber that is to be sawn on a sawhorse. Similarly, a chopsaw table can be assembled in approximately two minutes, by aligning a pair of sawhorses lengthwise that have been assembled with the combination of the present invention, and bolting a chopsaw at each end of its base to a board affixed to the respective bottom ledge of the middle two U-beam top joints. Multiple units of top joints and splay bars can be used to erect a stable sawhorse, work bench, work table, scaffold or platform of extensive length, width and height, limited only by the lengths of lumber available for the purpose.

The top joints in combination with the splay bars can be used to make a scaffold support with a cross-beam in joist orientation, that is, with its width vertical and resting on its long and narrow surface to span a considerable distance or to support a heavy weight. This assembly can be formed by using doubled-up lumber legs in each angled end of the U-beam top joint with lumber end gripper and in each bracket of the U-beam splay bar, such that one lumber leg of each doubled-up set is longer than the other, the top of the longer leg thereby gripping a middle portion of the vertical extent of cross-beam while the top of the shorter lumber leg grips, a bottom portion of the vertical width of the cross-beam. The cross-beam is thereby held in joist orientation, and can perform its support function, allowing a greater load to span ratio, than if the cross-beam were in a flat orientation.

The height of the working surface of the sawhorse, saw table, scaffold or other support structure can be varied simply by changing the length of the angled legs that are inserted into the top joints and the splay bars. By using a different length of lumber legs at one end of the sawhorse, chopsaw table, or scaffold support than at the other, it is possible to erect such a device that is suitable for various slopes or stairs.

DETAILED DESCRIPTION

Figure 1:
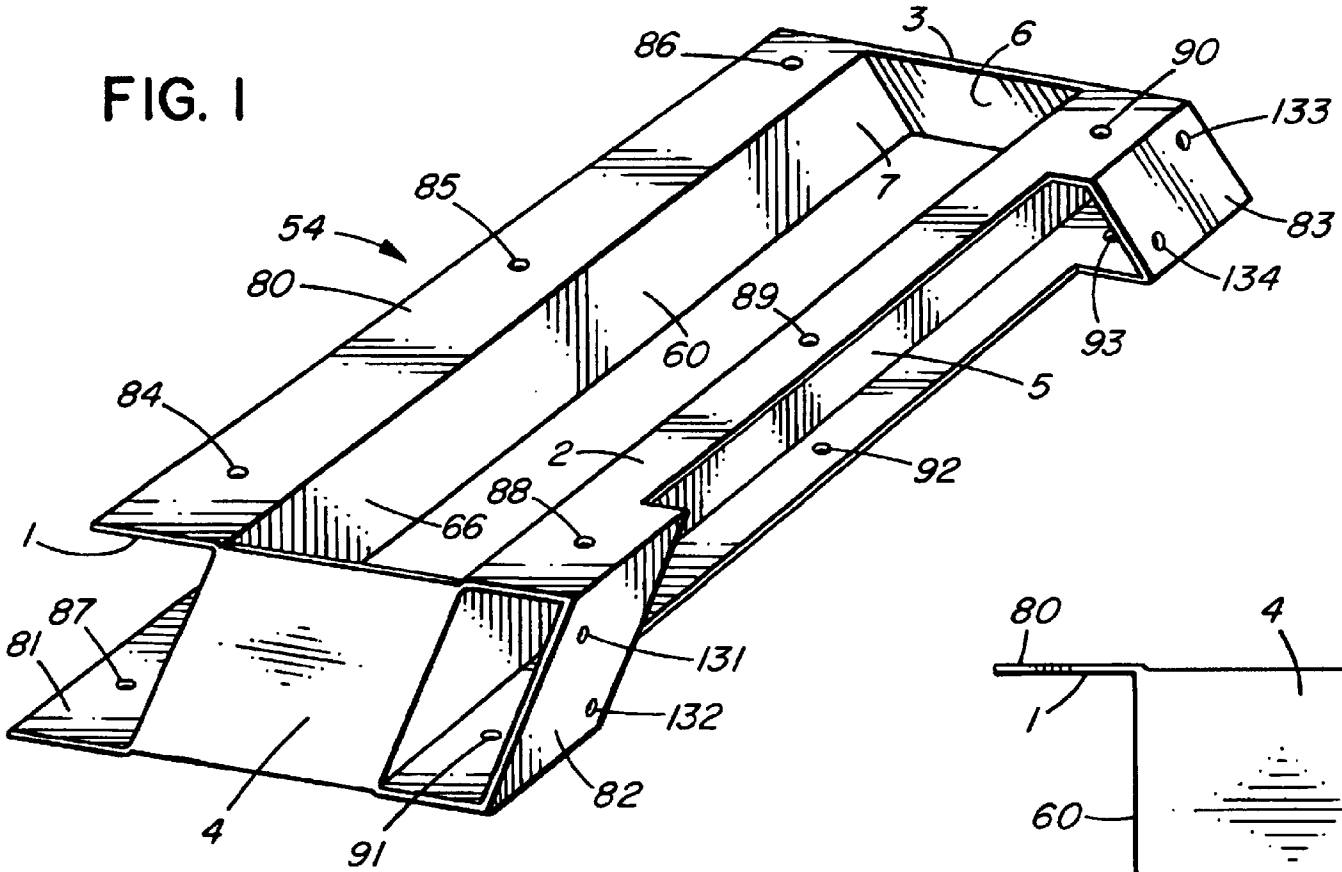
FIG. 1 is an end perspective of the U-beam top joint with lumber end gripper.
Figure 2:
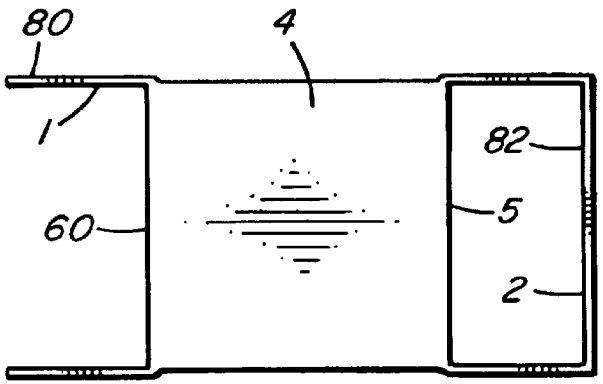
FIG. 2 is a side view of the U-beam top joint with lumber end gripper.
Figure 3:
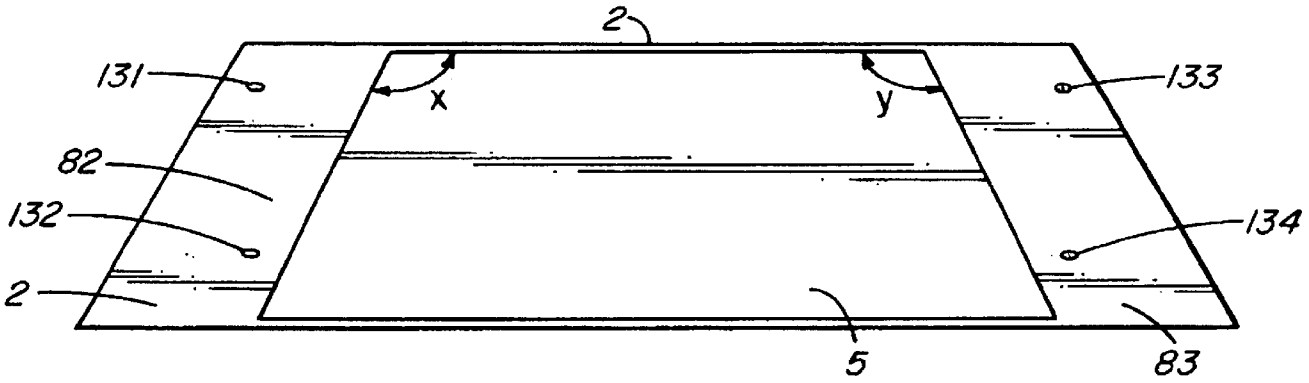
FIG. 3 is a side view of the U-beam top joint with lumber end gripper.
Figure 4:
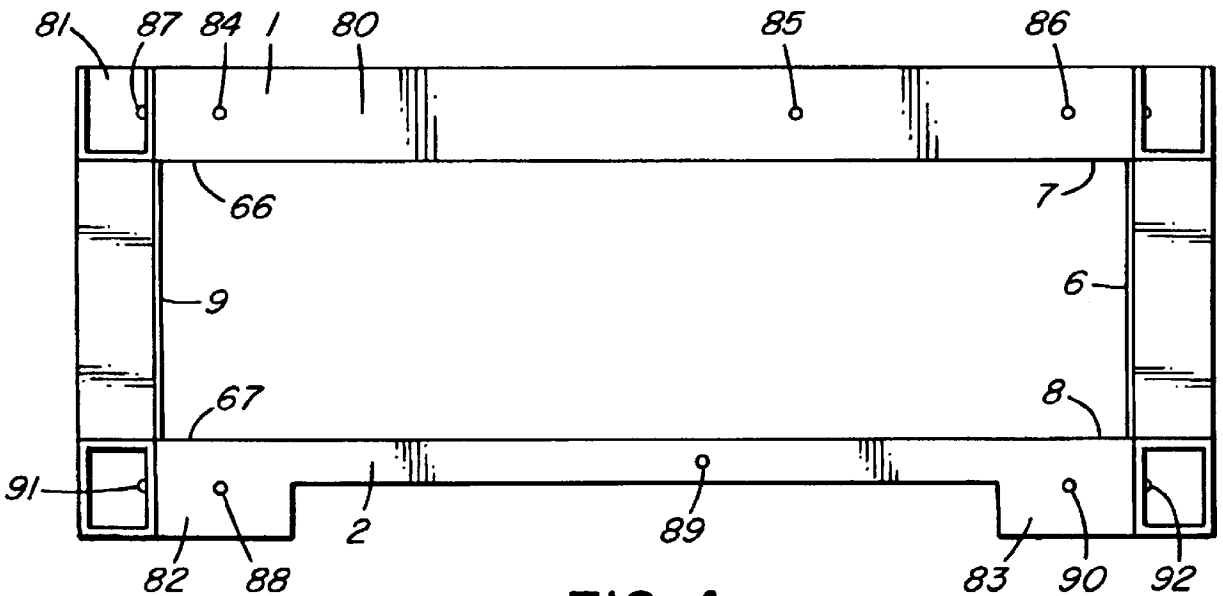
FIG. 4 is a top view of the U-beam top joint with lumber end gripper.

Referring to FIGS. 1, 2, 3 and 4, the U-beam top joint with lumber end gripper comprises a side U-beam 1 and a side bracket beam 2, and inward facing end brackets 3 and 4. The side U-beam 1 and the side bracket beam 2 are welded or molded onto the inward facing end brackets 3 and 4 such that the U-beam top joint with lumber end gripper has an overall rectangular shape when viewed from the top as in FIG. 3. The inward facing end bracket 4 has an inward facing lumber leg pivot surface 6 that is at an obtuse angle with respect to the top of the side beams 1 and 2, as shown in FIG. 2. Angle X should equal angle Y. To provide for a stable splay of legs, each of angles X and Y should be an angle of 105 degrees, or in the range of 100–120 degrees. The side U-beam 1 and the side bracket beam 2 have vertical flanks 60 and 5 respectively. The inward facing lumber leg pivot surface 6 has parallel flanks 7 and 8 affixed to its sides and extending perpendicular to the inward facing lumber leg pivot surface 6. Symetrically, the inward facing lumber leg pivot surface 9 of the inward facing end bracket 4 has parallel flanks 66 and 67. The inward facing end bracket 4 is thus likewise formed and affixed to the opposite ends of the side U-beam 1 and the side bracket beam 2, to form a symmetrical inward facing lumber leg pivot surface 9. The side U-beam 1 has upper ledge 80 and lower ledge 81, which enable the joint to be secured around other joining lengths of lumber in a structure. Additionally and for greater versatility, the side bracket beam 2 has enclosing side brackets 82 and 83 through which joining lengths of lumber could alternatively be inserted. The upper ledge has been pre-drilled with holes 84, 85, and 86, and the lower ledge has like holes, such as at 87. The side bracket beam likewise has such pre-drilled or pre-formed holes, 88, 89, 90, 91, 92, 93, 131, 132, 133, and 134, through which nails or screws can be inserted to secure a lumber length in the side U-beam 1 or the side bracket beam 2.

Figure 5:
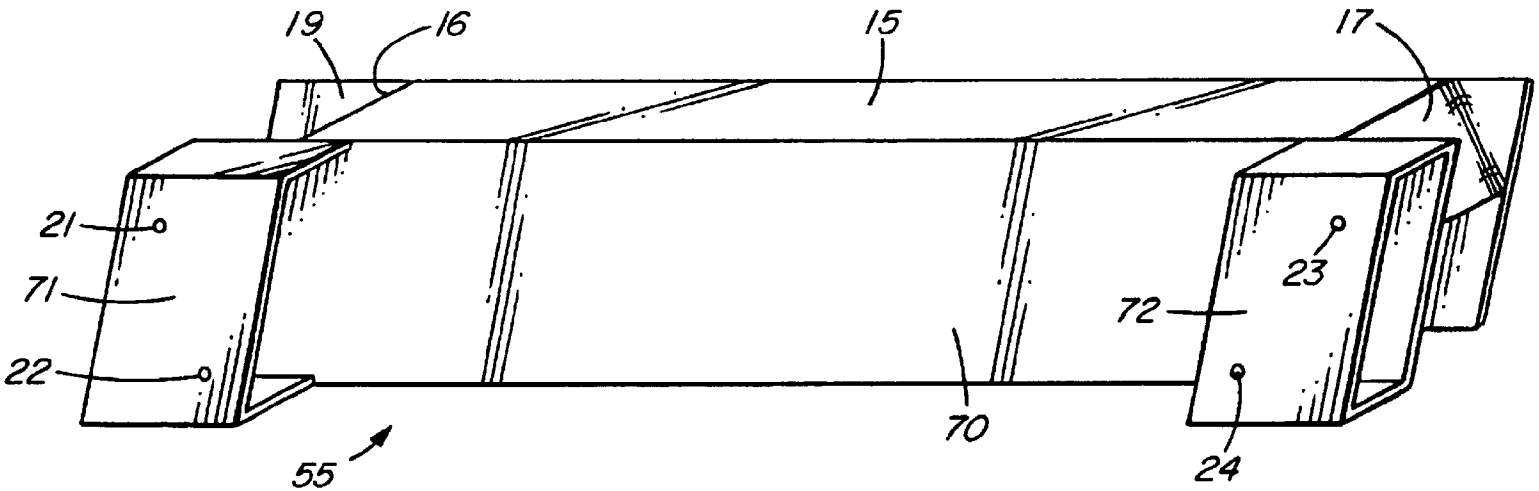
FIG. 5 is a side view of the U-beam splay bar of the combination.
Figure 6:
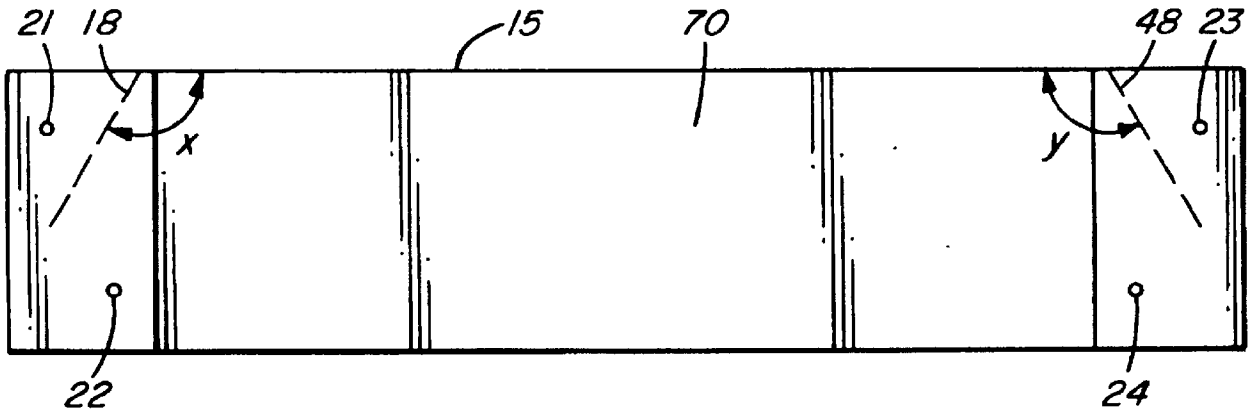
FIG. 6 is a side view of the U-beam splay bar of the combination.
Figure 7:
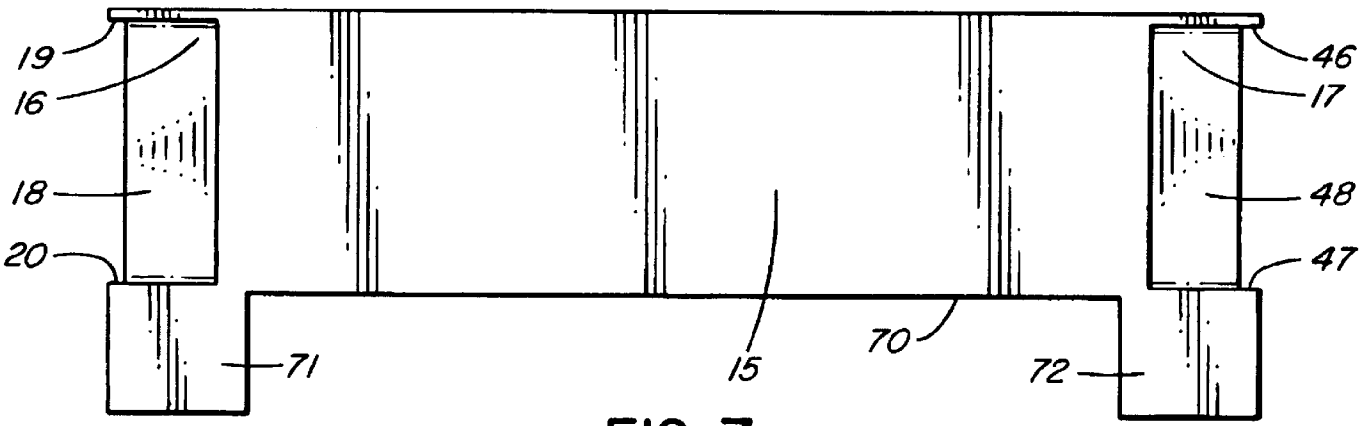
FIG. 7 is a top view of the U-beam splay bar of the combination.

Referring to FIGS. 5, 6, and 7, the U-beam splay bar comprises a sturdy U-beam 15, joining two outward facing end brackets 16 and 17. The outward facing end bracket 16 has an outward facing lumber leg guiding surface 18, between parallel flanks 19 and 20. The outward facing lumber leg guiding surface 18 is fixed at the same obtuse angle X with respect to the length of the U-beam 15, as the inward facing lumber leg pivot surface 4 of the U-beam top joint with lumber end gripper is with respect to the length of the side U-beams and the side bracket beam 2 is in FIG. 3. The other outward facing end bracket 17 is likewise formed and affixed with its outward facing lumber leg guiding surface 48 at a symmetrical obtuse angle Y with respect to the U-beam 15, as shown in FIG. 6. The outward facing end brackets 17 also has a pair of parallel flanks 46 and 47. The flanks 19, 20, 46 and 47 extend perpendicular along opposite sides of the respective outward facing lumber leg guiding surfaces 18 and 48. The inward facing lumber leg pivot surface 6 of the inward facing end bracket 3 of the U-beam top joint with lumber end gripper shown in FIGS. 1–4 and the outward facing lumber leg guiding surface 18 of the outward facing end bracket 16 of the U-beam splay bar of FIG. 5–7 are thus both angled to fit a lumber leg that is placed in them at the same obtuse angle with respect to the length of the top joint and to the U-beam splay bar. The other inward facing end bracket 4 of the U-beam top joint with lumber end gripper and the other outward facing end bracket 17 of the U-beam splay bar likewise provide a symetrical angle for another lumber leg. Like the top joint, the U-beam splay bar also has a side bracket beam 70, with enclosing side brackets 71 and 72.

The U-beam splay bar can be welded, molded or otherwise formed to make its outer end brackets 16 and 17. An efficient way to form the outer end brackets is to cut the seams of a U-beam a short distance from each end thereof, then to bend the middle surface between the flanks of the U-beam, and finally to weld the resulting lumber leg guiding surface into position between the flanks at the desired angle. The outer end brackets 16 and 17 of the U-beam splay bar have been pre-drilled or formed with holes 21, 22, 23 and 24 respectively, in order to facilitate the placement of retaining nails or screws into the lumber legs to be used with the U-beam top joint with lumber end gripper and U-beam splay bar.

Figure 8:
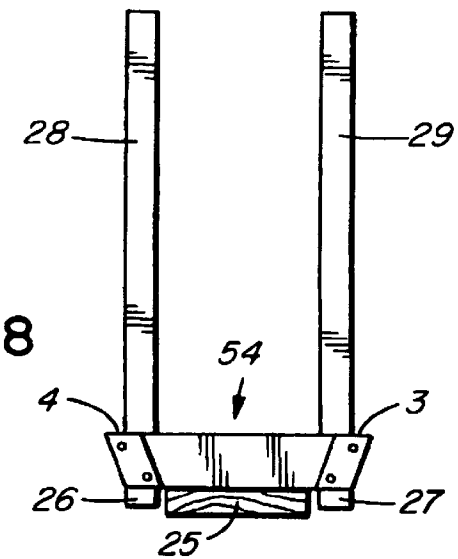
FIG. 8 shows the first stage in assembling a sawhorse, using an inverted U-beam top joint with lumber end gripper on a lumber cross-beam and two lumber legs.

Referring to FIG. 8, a lumber cross-beam 25 is laid on the ground. On top of it is placed an upside down U-beam top joint with lumber end gripper, with its inner end brackets 3 and 4 protruding over each side of the lumber cross-beam 25. The top portions 26 and 27 of each of a pair of inverted lumber legs 28 and 29 is inserted in the direction of the arrows through the inner end brackets 3 and 4 respectively on each side of the lumber cross-beam 25.

Figure 9:
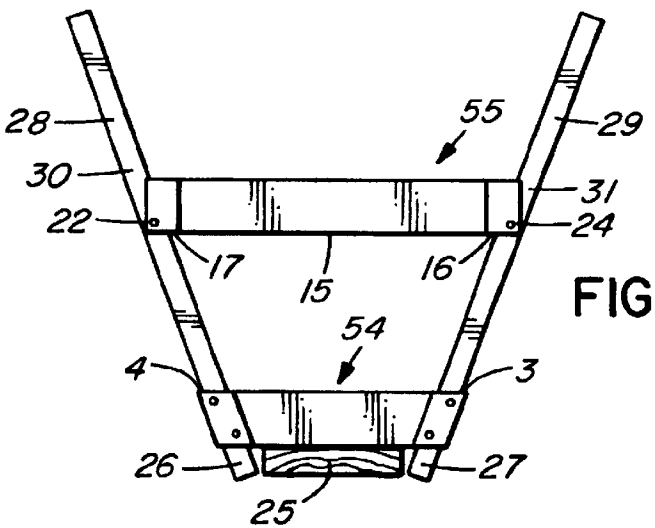
FIG. 9 shows the next stage, using the assembly of FIG. 8 in combination with the U-beam splay bar.

Referring to FIG. 9, a U-beam splay bar is placed between the the middle portions 30 and 31 of the lumber legs 28 and 29 such that the outward facing lumber leg guiding surfaces of the outward facing end brackets 16 and 17 of the U-beam splay bar respectively align with the inward facing lumber leg pivot surfaces of the inward facing end brackets 3 and 4 of the U-beam top joint with lumber end gripper. The assembler then presses down on the U-beam 15 of the U-beam splay bar in the direction shown by the arrow until the U-beam splay bar forces the middle portions 30 and 31 apart and pivots the top portions 26 and 27 of the lumber legs 28 and 29 against the lumber cross-beam 25, the entire assembly becoming rigid in the process. The U-beam splay bar is then nailed or screwed into the rigid lumber legs 28 and 29 through the holes 22 and 24.

A second U-beam top joint with lumber end gripper, a second pair of lumber legs, and a second U-beam splay bar are then used at the opposite end of the lumber cross-beam 25 to assemble another set of rigid legs gripping the lumber cross-beam 25.

Figure 10:
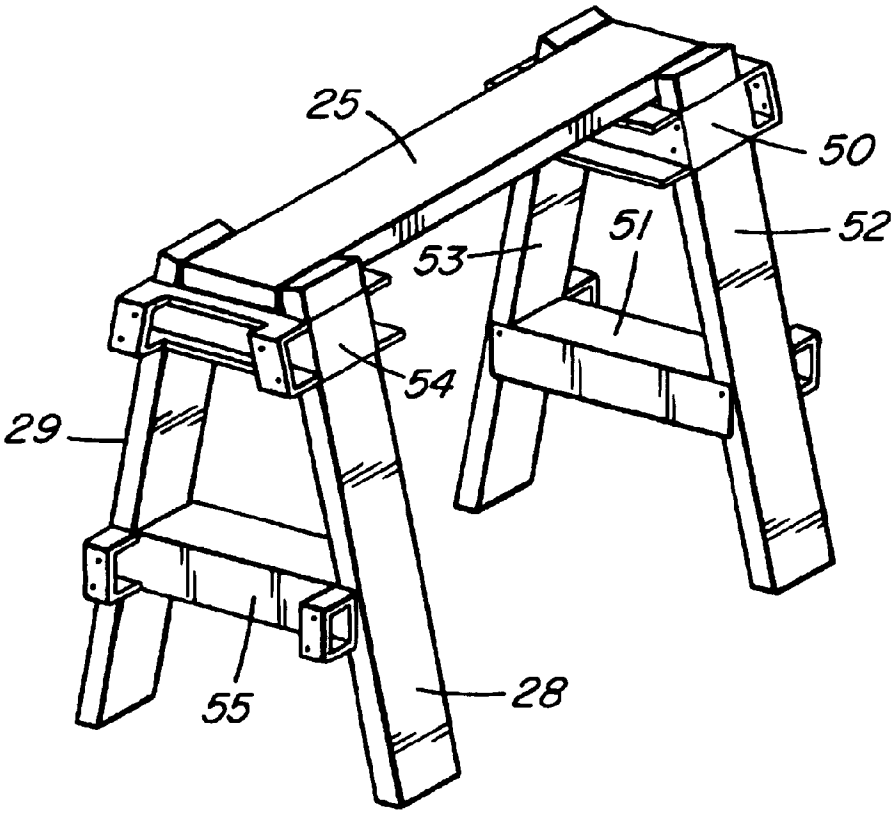
FIG. 10 shows an isometric view of the upright sawhorse formed by repeating the stages shown in FIGS. 8 and 9.

Referring to FIG. 10, the resulting assembled sawhorse is shown turned upright and ready for work, with its lumber legs 29 and 28, its second pair of lumber legs 52 and 53, its second U-beam top joint with lumber end gripper 50, its second U-beam splay bar 51, its cross-beam 25, and the first U-beam top joint with lumber end gripper 54 and the first U-beam splay bar 55.

Figure 11:
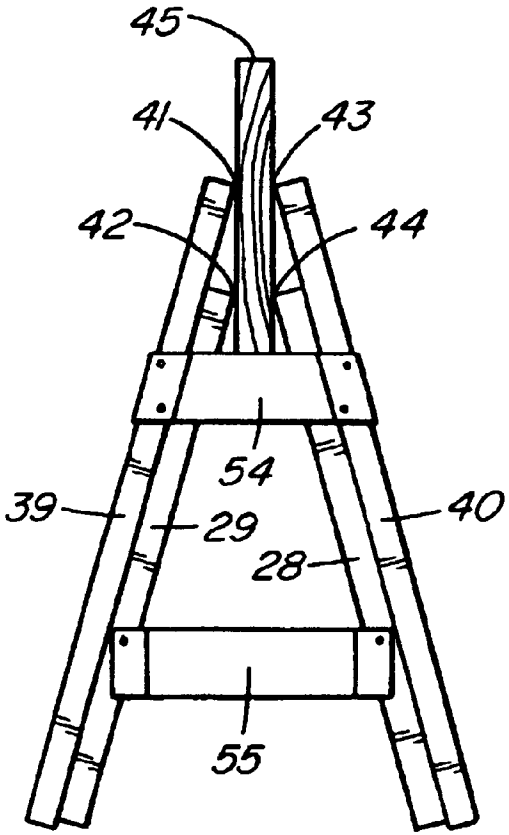
FIG. 11 shows an end view of a scaffold support formed by the top joints and splay bars in conjunction with doubled-up lumber legs.

Referring to FIG. 11, a second, longer pair of lumber legs 39 and 40 are doubled-up with the lumber legs 29 and 28 in the first U-beam top joint with lumber end gripper 54 and the first U-beam splay bar 55 in order to provide four gripping edges 41, 42, 43, and 44 on the lumber cross-beam joist 45 and to keep it from tipping sideways under a load. If the lumber cross-beam joist were just balanced on the top joints without the gripping edges, it would easily tip over from a load moving laterally. The lower gripping edges 42 and 44 stabilize the lumber cross-beam joist 45, and the upper gripping edges 41 and 43 provide even greater stability against the possible leverage effect on the lower gripping edges if a load on the lumber cross-beam joist 45 were to be moved laterally. This configuration is therefore suitable for use as a scaffold support.

Figure 12:
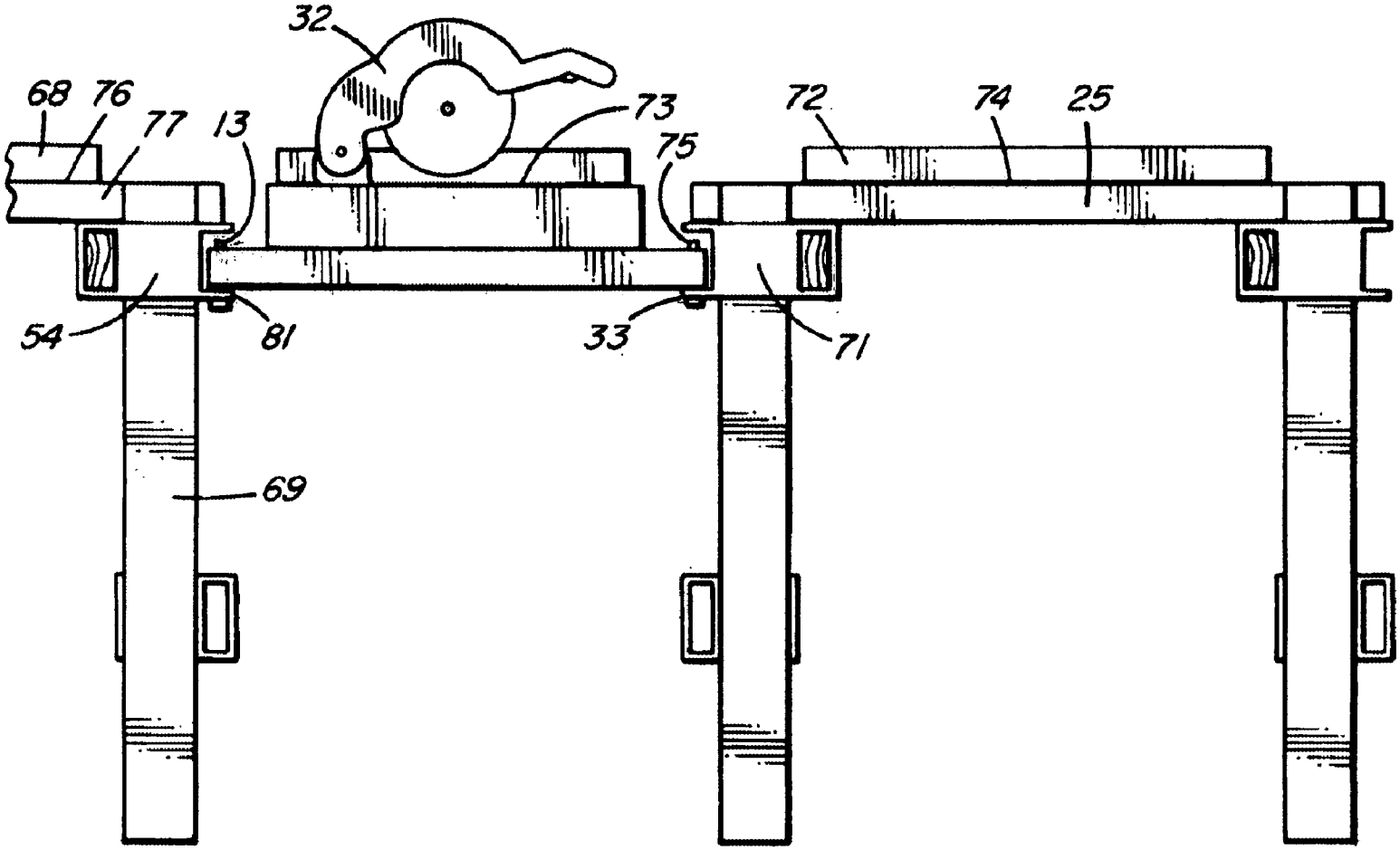
FIG. 12 shows a front view of a chopsaw bolted to a pair of the sawhorses assembled with the top joints and splay bars.
Figure 13:
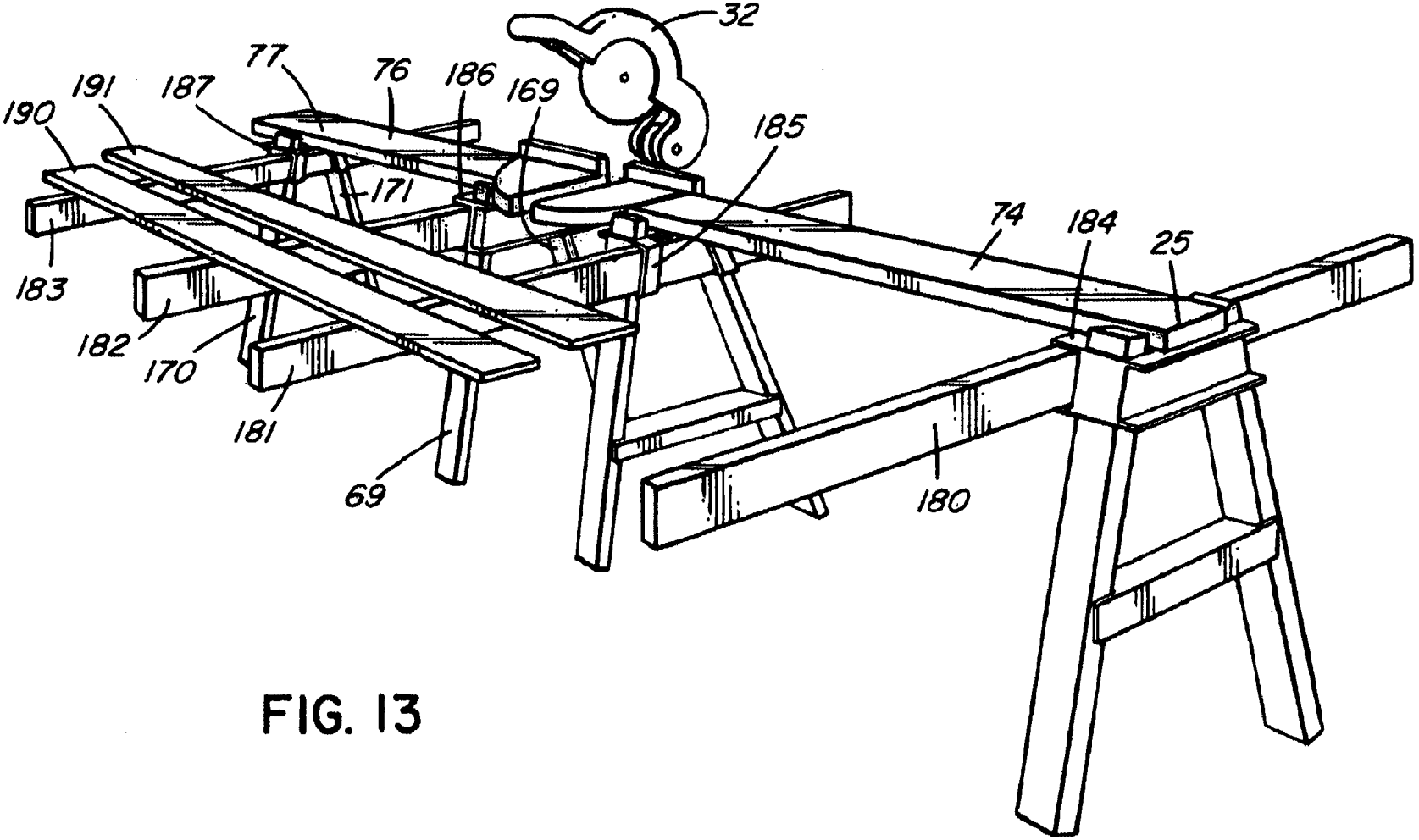
FIG. 13 shows an isometric view of the chopsaw and sawhorse structure, with lumber support fence structures inserted into the side brackets of the U-beam top joints.

Referring to FIGS. 12 and 13, two sawhorses formed as described above, are lined up in order that a chopsaw 32 can be attached by nutted bolts 13 and 75 to ledges 33 and 81 affixed to the top joints 71 and 54 on the respective sawhorses. The U-beam top joint with lumber end gripper 54 in this configuration has its ledge 81 facing outwards (instead of inwards under the lumber cross-beam 25 as in FIG. 9). The right lumber legs 69 and 169 of the left sawhorse are adjacent to and below the chopsaw 32, while the far left lumber legs 170 and 171, could be as far away as is desired to support the lengths of lumber to be sawn. Washers can be used to adjust the height of the chopsaw to align its lumber support surface 73 with the tops 76 and 74 of lumber cross-beams 77 and 25. Lumber guiding fences 68 and 72 are nailed to the back of the lumber cross-beams 77 and 25 respectively. The lumber fence support beams 180, 181, 182 and 183 are inserted into the side brackets 184, 185, 186, and 187 respectively in order to support lengths 190 and 191 of lumber prior to being cut.

Figure 14:
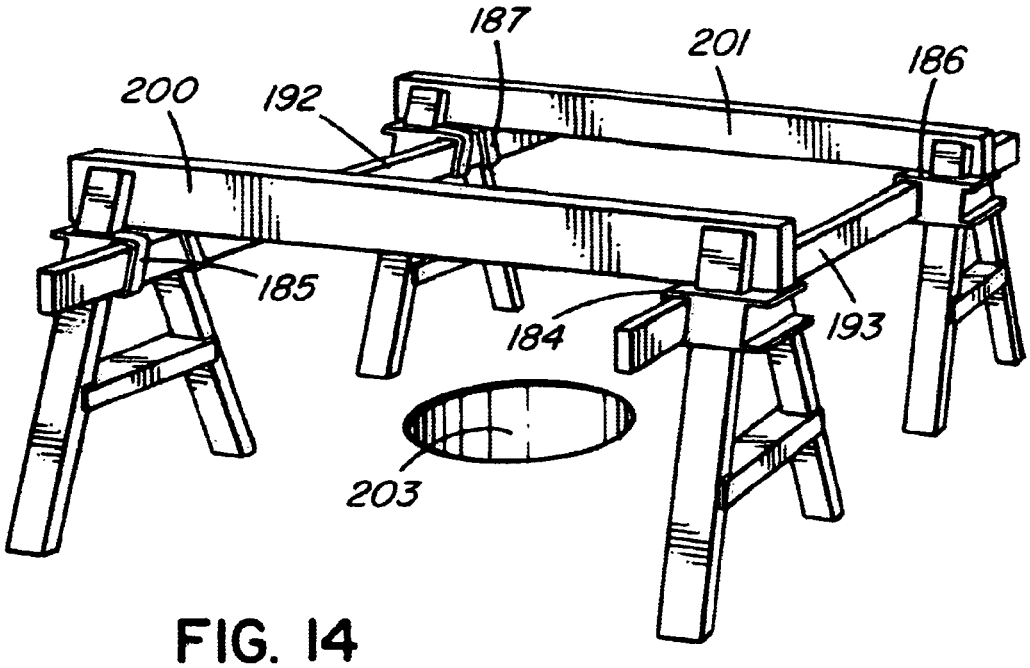
FIG. 14 shows an isometric view of a safety barrier made with a pair of sawhorses joined by 2×4 inch lumber beams inserted through the side brackets of the U-beam top joints.

Referring to FIG. 14, lumber side beams 192 and 193 have been inserted through aligned side brackets 193 and 186 and aligned side brackets 185 and 187 respectively, to join the two sawhorses 200 and 201 formed with their respective top joints. An effective and sturdy safety barrier results to surround the hazardous hole 203.

Figure 15:
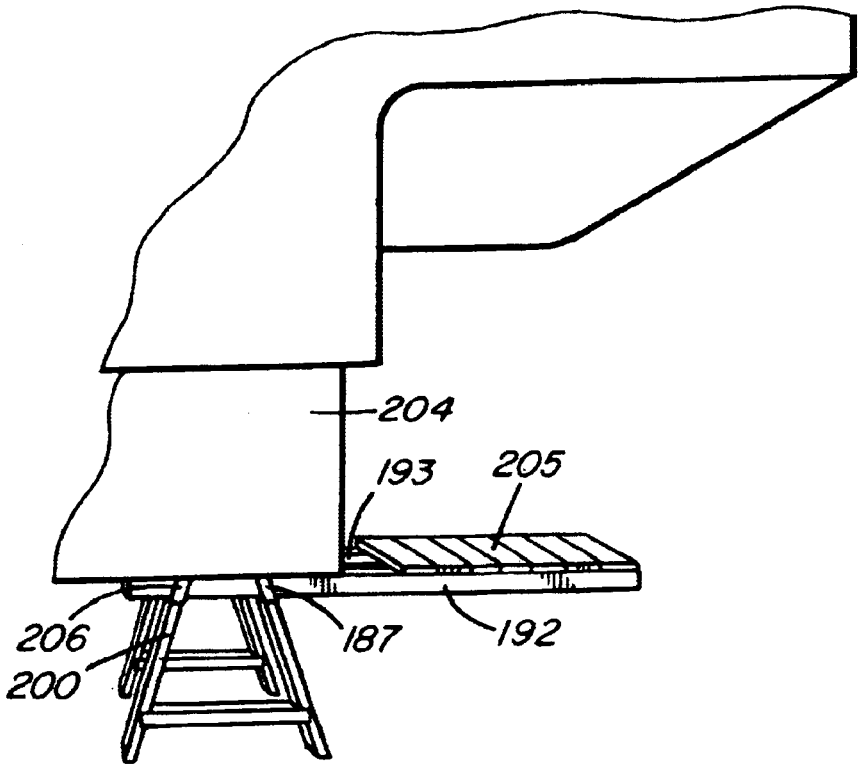
FIG. 15 shows a camper top supported by a sawhorse structure, with a table top structure inserted into the side brackets of the U-beam top joints.

Referring to FIG. 15, the sawhorse 200 not only supports the camper top 204, but also enables the platform 205 to be attached and supported by the lumber beams 192 and 193 inserted into the side brackets of the top joints of the sawhorse, as shown at side brackets 187 and 206.

Figure 16:
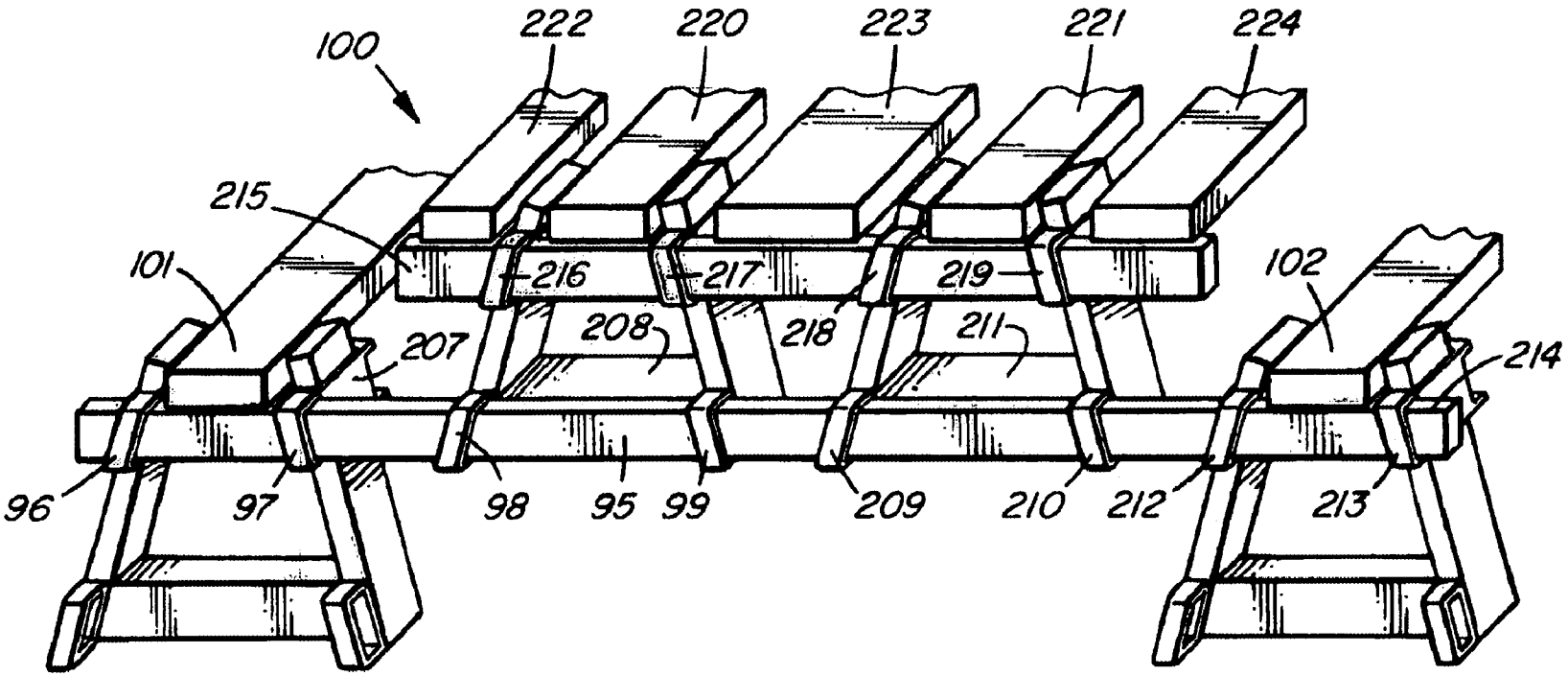
FIG. 16 shows a perspective of the end of a picnic table formed by joining two benches each built using the angled gripping joint combination, with a lumber length through the side brackets of the U-beam top joints of the benches and through the side brackets of the splay bars of the table structure, which is also built using the angled gripping joint combination.

Referring to FIG. 16, the end of a picnic table 100 is shown, formed by joining two benches 101 and 102 each built using the angled gripping joint combination, with a lumber length 95 extending through the enclosing side brackets 96 and 97 of top joint 207 of one bench, through the aligned and enclosing side brackets 98 and 99 of the U-beam splay bar 208 of the first table top support structure, through the aligned and enclosing side brackets 209 and 210 of the U-beam splay bar 211 of the second table top support structure, and finally through the aligned and enclosing side brackets 212 and 213 of the top joint 214 of the other bench. The first table top structure is also joined to the second table top by a joining lumber length 215, that extends through the side brackets 216 and 217 of one top joint and side brackets 218 and 219 of a second top joint. The table top beams 200 and 221 are secured directly by the two table top structures formed with the angled gripping joint combination, while the interspaced table top beams 222, 223, and 224 are nailed or screwed to the joining lumber length 215. The angled gripping joint combination thus not only secures individual support structures, but also enables joining pieces of lumber to integrate and further secure a larger structure, with the U-beam top joints interacting not only with the U-beam splay bars of their own immediate support structures, but also interlinking with the U-beam splay bars of other such support structures.

The U-beam top joint with lumber end gripper can be made to any size necessary to fit around the various dimensions of lumber legs and lumber cross-beams. The U-beam splay bar can likewise be made having any necessary size of outer bracket and length of bar to fit the lumber legs and place them at the desired angle with respect to each other in the assembled sawhorse. The enclosing side brackets can likewise be made to accommodate typical lumber dimensions. For example, where the lumber legs are nominally "2 by 4" pieces of lumber, rough finished to approximately 1½ inches by 3 ½ inches, and the lumber cross-beam is "2 by 6", rough finished to approximately 1½ inches by 5 ½ inches a top joint having an opening of 4 inches between parallel side beams and 8¾ inches between the parallel top edges of the inward facing lumber leg pivot surfaces of the inward facing end brackets, would accommodate the pieces with ample tolerance for their insertion and yet would enable the required rigidity once the leg speader is pressed into position. That is, a tolerance of approximately ½ inch between the flanks of the end brackets and a finer tolerance of approximately ¼ inch between the parallel top edges of the inward facing lumber leg pivot surfaces of the inward facing end brackets, works well. A U-beam splay bar of 13 inches between the parallel top edges of the outward facing lumber leg guiding surfaces of the outward facing end brackets would give a stable spread of the lumber legs once inserted and used in combination with the U-beam top joint with lumber end gripper proportions noted above.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. An angled gripping joint combination for support structures, comprising:

(a) a top joint, comprising:
- (i) a first side beam;
- (ii) a second side beam; and
- (iii) a pair of spaced inward facing lumber leg support surfaces joining the first side beam and second side beam together, each inward facing lumber leg support surface dimensioned to accept a lumber leg between the support surface, the first side beam and the second side beam; and (b) a splay bar, comprising:
- (i) a pair of opposed outward facing lumber leg guiding surfaces;
- (ii) a connecting member extending longitudinally between the lumber leg guiding surfaces and connecting them together; and
- (iii) a pair of spaced opposed flanks extending outwardly from each guiding surface in parallel alignment dimensioned to accept a lumber leg between each pair of spaced opposing flanks;

wherein a pair of lumber legs may be positioned between respective inward facing lumber leg support surfaces and between the first side beam and second side beam of the top joint and adjacent the outward facing lumber leg guiding surfaces and between each respective pair of flanks of the splay bar so that first ends of the lumber legs adjacent the top joint are forced toward each other when the splay bar is moved in the direction of the top joint to force the lumber legs to pivot about the inward facing lumber leg support surfaces.

2. The combination of claim 1 wherein side enclosing brackets are affixed to the second side beam of the top joint.

3. The combination of claim 1 wherein side enclosing brackets are affixed to a side of the splay bar.

4. The combination of claim 1 wherein side enclosing brackets are affixed to the second side beam of the top joint and side enclosing brackets are affixed to a side of the splay bar.

5. The combination of claim 1 wherein each flank extends in a perpendicular direction with respect to the outward facing lumber leg guiding surface.

6. The combination of claim 1 in which the flanks include holes through which a nail may be inserted into a lumber leg.

7. The combination of claim 1 wherein the top joint further comprises an axial slot dimensioned to accept a lumber member therein to extend axially in the direction of the longitudinal axis of the first side beam.

8. The combination of claim 7 wherein the axial slot is positioned on the second side beam.

9. The combination of claim 7 wherein the axial slot is positioned on the first side beam.

10. The combination of claim 1 wherein the splay bar further comprises an axial slot dimensioned to accept a lumber member therein to extend axially in the direction of the longitudinal axis of the splay bar.

11. The combination of claim 1 wherein the first side beam comprises a first surface with the lumber leg support surfaces positioned at a predetermined angle with respect to the first surface and wherein the outwardly facing lumber leg guiding surfaces of the splay bar are positioned at the pre-determined angle with respect to the longitudinal axis of the connecting member.

* * * * *